US007846007B2

(12) United States Patent
Stinson et al.

(10) Patent No.: US 7,846,007 B2
(45) Date of Patent: Dec. 7, 2010

(54) SYSTEM AND METHOD FOR DRESSING A WAFER POLISHING PAD

(75) Inventors: Mark G. Stinson, Wood River, IL (US); Madhavan S. Esayanur, St. Peters, MO (US); Dennis Buese, O'Fallon, MO (US); Emanuele Corsi, Novara (IT); Ezio Bovio, Novara (IT); Antonio Maria Rinaldi, Novara (IT); Larry Flannery, Warrenton, MO (US)

(73) Assignee: MEMC Electronic Materials, Inc., St. Peters, MO (US)

( * ) Notice: Subject to any disclaimer, the term of this patent is extended or adjusted under 35 U.S.C. 154(b) by 0 days.

(21) Appl. No.: 12/351,290

(22) Filed: Jan. 9, 2009

(65) Prior Publication Data

US 2009/0176441 A1 Jul. 9, 2009

Related U.S. Application Data

(63) Continuation-in-part of application No. 11/771,495, filed on Jun. 29, 2007.

(60) Provisional application No. 60/806,384, filed on Jun. 30, 2006.

(51) Int. Cl.
*B24B 49/00* (2006.01)
*B24B 51/00* (2006.01)

(52) U.S. Cl. ..... 451/5; 451/10; 451/21; 451/56; 451/72; 451/443

(58) Field of Classification Search ..... 451/21, 451/54, 56, 65, 72, 443, 444, 5, 10
See application file for complete search history.

(56) References Cited

U.S. PATENT DOCUMENTS

| | | | | |
|---|---|---|---|---|
| 5,664,987 | A * | 9/1997 | Renteln | 451/21 |
| 5,690,544 | A * | 11/1997 | Sakurai | 451/444 |
| 5,961,377 | A * | 10/1999 | Jeong | 451/56 |
| 6,113,462 | A * | 9/2000 | Yang | 451/5 |
| 6,302,762 | B1 | 10/2001 | Inaba et al. | |
| 6,309,277 | B1 * | 10/2001 | Arcayan et al. | 451/8 |
| 6,371,836 | B1 * | 4/2002 | Brown et al. | 451/56 |
| 6,607,423 | B1 | 8/2003 | Arcyan et al. | |
| 6,875,086 | B2 | 4/2005 | Golzarian et al. | |
| 6,896,583 | B2 | 5/2005 | Rodriquez et al. | |
| 6,910,947 | B2 * | 6/2005 | Paik | 451/21 |
| 6,939,208 | B2 * | 9/2005 | Kamimura et al. | 451/56 |
| 6,976,907 | B2 | 12/2005 | Golzarian et al. | |
| 7,033,253 | B2 * | 4/2006 | Dunn | 451/56 |
| 2003/0190873 | A1 * | 10/2003 | Wang et al. | 451/56 |
| 2004/0023602 | A1 | 2/2004 | Moloney et al. | |
| 2005/0164613 | A1 | 7/2005 | Seike et al. | |

* cited by examiner

*Primary Examiner*—Timothy V Eley
(74) *Attorney, Agent, or Firm*—Armstrong Teasdale LLP

(57) ABSTRACT

A system for polishing a semiconductor wafer. The system includes a polishing apparatus having a rotatable polishing pad for polishing the wafer. A dressing apparatus is mounted adjacent the polishing pad for dressing the polishing pad. The dressing apparatus includes a dressing member engageable with the polishing pad. A cleaning apparatus is mounted adjacent the polishing pad for removing particulate and chemicals from the polishing pad. The system includes a controller for controlling the dressing apparatus and the cleaning apparatus.

22 Claims, 18 Drawing Sheets

SYSTEM AND METHOD FOR DRESSING A WAFER POLISHING PAD

CROSS-REFERENCE TO RELATED APPLICATION

The present application claims priority to U.S. Provisional Application No. 60/806,384, filed Jun. 30, 2006, and U.S. patent application Ser. No. 11/771,495, filed Jun. 29, 2007, both of which is herein incorporated by reference in their respective entireties.

FIELD OF THE INVENTION

The present invention relates generally to an apparatus for dressing a polishing pad used to polish semiconductor wafers and a method for dressing a polishing pad.

BACKGROUND OF THE INVENTION

A semiconductor wafer is polished to achieve a flat surface required for fabricating of today's advanced semiconductor devices. One way to effectively polish a semiconductor wafer involves a chemical mechanical polishing system. The polishing system typically includes a silicon carbide (SiC) block for mounting a wafer thereon and a polishing pad. Both the SiC block and the polishing pad are rotatable. As the SiC block and the polishing pad rotate, the wafer, which is mounted on the block, is pressed against the polishing pad. A solution of silica and potassium hydroxide (KOH) is applied to the surface of the polishing pad. The friction created between the polishing pad and the wafer, in combination with the applied solution, smoothes the etched surface of the wafer.

Important characteristics in a polished wafer are thickness uniformity, smoothness and flatness of the wafer surface. However, polishing pads degrade over time producing wafers of lesser quality. Wafers having non-uniform surfaces are sometimes caused by the surface of the polishing pad being rough, especially when the pad has been used a number of times. Thus, during the life of the polishing pad, it has become necessary to dress the polishing surface of the pad so that the wafers produced using the pad are more uniform, flat and smooth. One way to dress a polishing pad is by smoothing the polishing surface of the pad using an abrasive dressing element.

An example of an apparatus and method of dressing a polishing pad is disclosed in U.S. Pat. No. 6,976,907. The apparatus includes a cylindrical dressing member (i.e., conditioning piece) that is rotatable about an imaginary axis of rotation that is generally parallel to the polishing surface. A polishing pad surface metrology system is used to address particular non-uniformity on the polishing surface of the polishing pad and provide a uniform polishing pad surface. In other words, the polishing pad surface is analyzed to determine where and how the surface should be dressed.

SUMMARY OF THE INVENTION

A system according to one aspect of the present invention for polishing a semiconductor wafer comprises a polishing apparatus including a rotatable polishing pad for polishing the wafer. The system further includes a dressing apparatus mounted adjacent the polishing pad for dressing the polishing pad. The dressing apparatus includes a dressing member engageable with the polishing pad. In addition, the system comprises a cleaning apparatus mounted adjacent the polishing pad for removing particulate and chemicals from the polishing pad and a controller for controlling the dressing apparatus and the cleaning apparatus.

In another aspect, the present invention includes a dressing system for dressing a polishing surface of a polishing pad for a semiconductor wafer. The system comprises a dressing arm having a rotatable dressing member mounted thereon. The dressing arm is mounted for selectively moving the dressing member across the polishing surface and for forcing the member against the polishing pad with a predetermined amount of force. The system also includes a cleaning arm having a cleaning member mounting thereon. The cleaning arm is mounted for selectively moving the cleaning member across the polishing surface of the polishing pad.

In still another aspect, the present invention includes a method of dressing a polishing surface of a polishing pad used in polishing of wafers. The method comprises obtaining a radial profile of a wafer polished with the polishing pad and categorizing the polished wafer into a profile category based on the radial profile of the wafer. A recipe is selected corresponding to the selected category. Further, the method comprises dressing the polishing surface of the pad according to the selected recipe using a dressing apparatus and cleaning the dressed polishing surface of the pad.

BRIEF DESCRIPTION OF THE DRAWINGS

Corresponding reference characters indicate corresponding parts throughout the drawings.

DETAILED DESCRIPTION OF THE DRAWINGS

Figure 1:
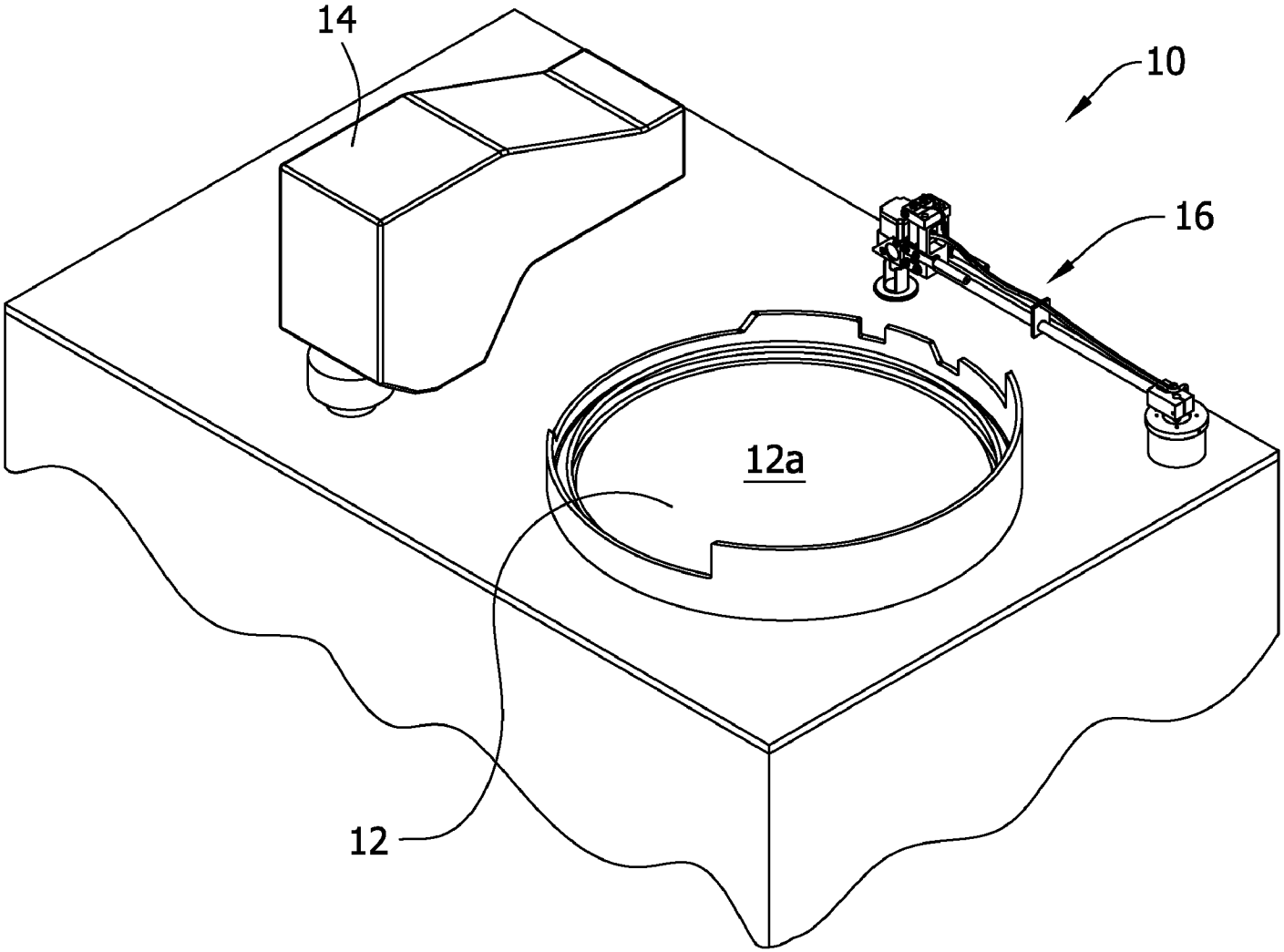
FIG. 1 is a perspective of one embodiment of a wafer polishing system.
Figure 4:
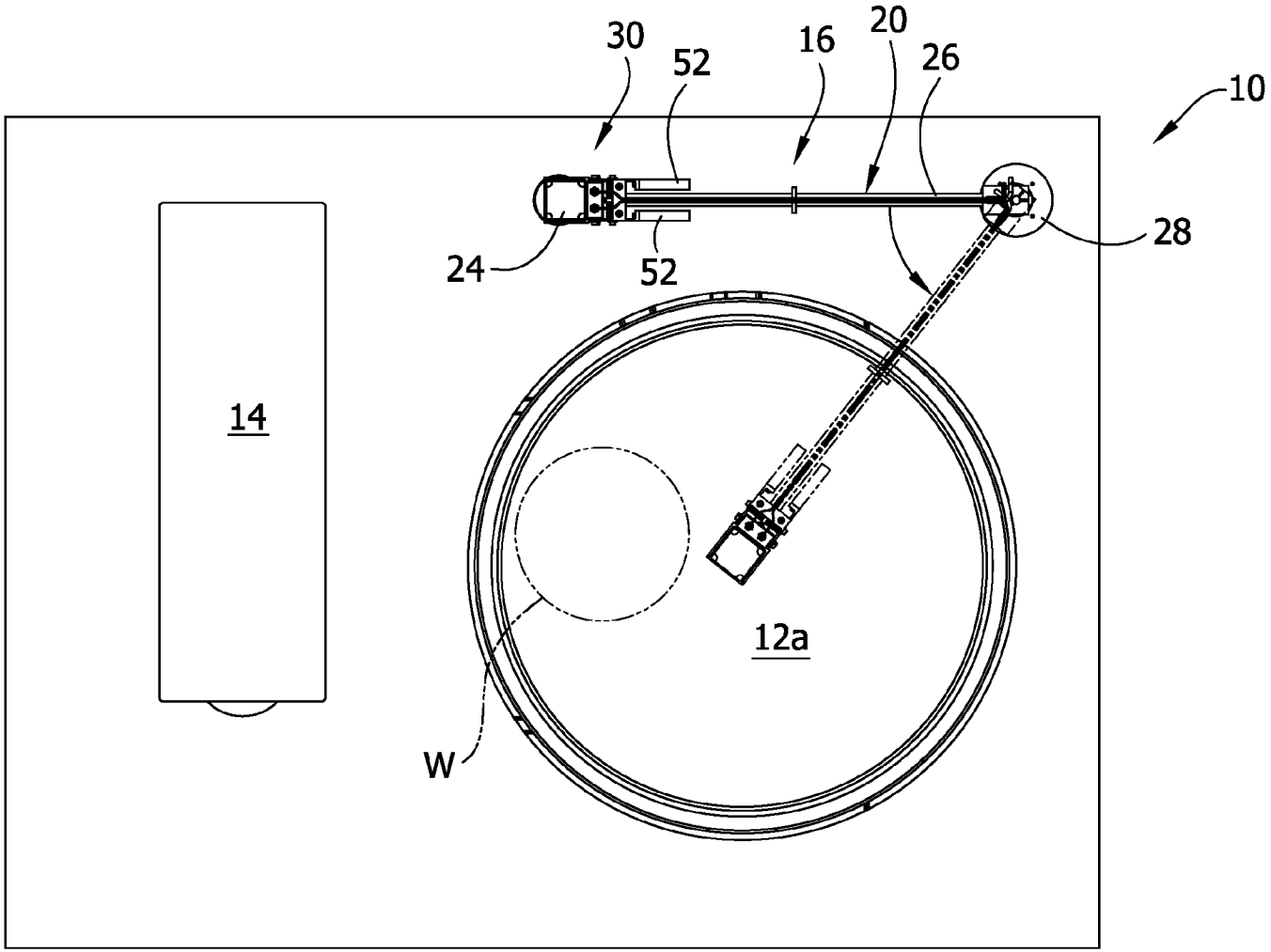
FIG. 4 is a top plan of the wafer polishing system of FIG. 1.

Referring now to the drawings, and in particular to FIGS. 1 and 4, one embodiment of a wafer polishing system constructed according to the principles of the present invention is generally designated in its entirety by the reference number 10. The wafer polishing system 10 includes a polishing pad 12 mounted on a pivotable base (not shown) and a wafer mounting device 14 having a rotatable head (removed for clarity) for mounting a semiconductor wafer W (FIG. 4) on the pad. The wafer mounting device 14 holds a wafer W and brings the wafer into contact with the polishing pad 12 as both the wafer and the polishing pad are being rotated. The polishing pad 12, through abrasion and other chemicals which may be applied to the surface of the polishing pad, polishes the surface of the wafer. As is known in the art, a polishing surface 12*a* of the polishing pad 12 may become worn or otherwise roughened during continued use, which can affect the polished surface of the wafer. A dressing apparatus, generally indicated at 16, of the wafer polishing system 12 is constructed for dressing (i.e., abrading and compressing) the polishing surface 12*a* of the polishing pad 12 to ensure the polishing pad shapes wafers so they have a generally uniform thickness and a smooth polished surface. It is contemplated and within the scope of the invention that the system and/or apparatus may differ in construction from that shown in the drawings.

Figure 2:
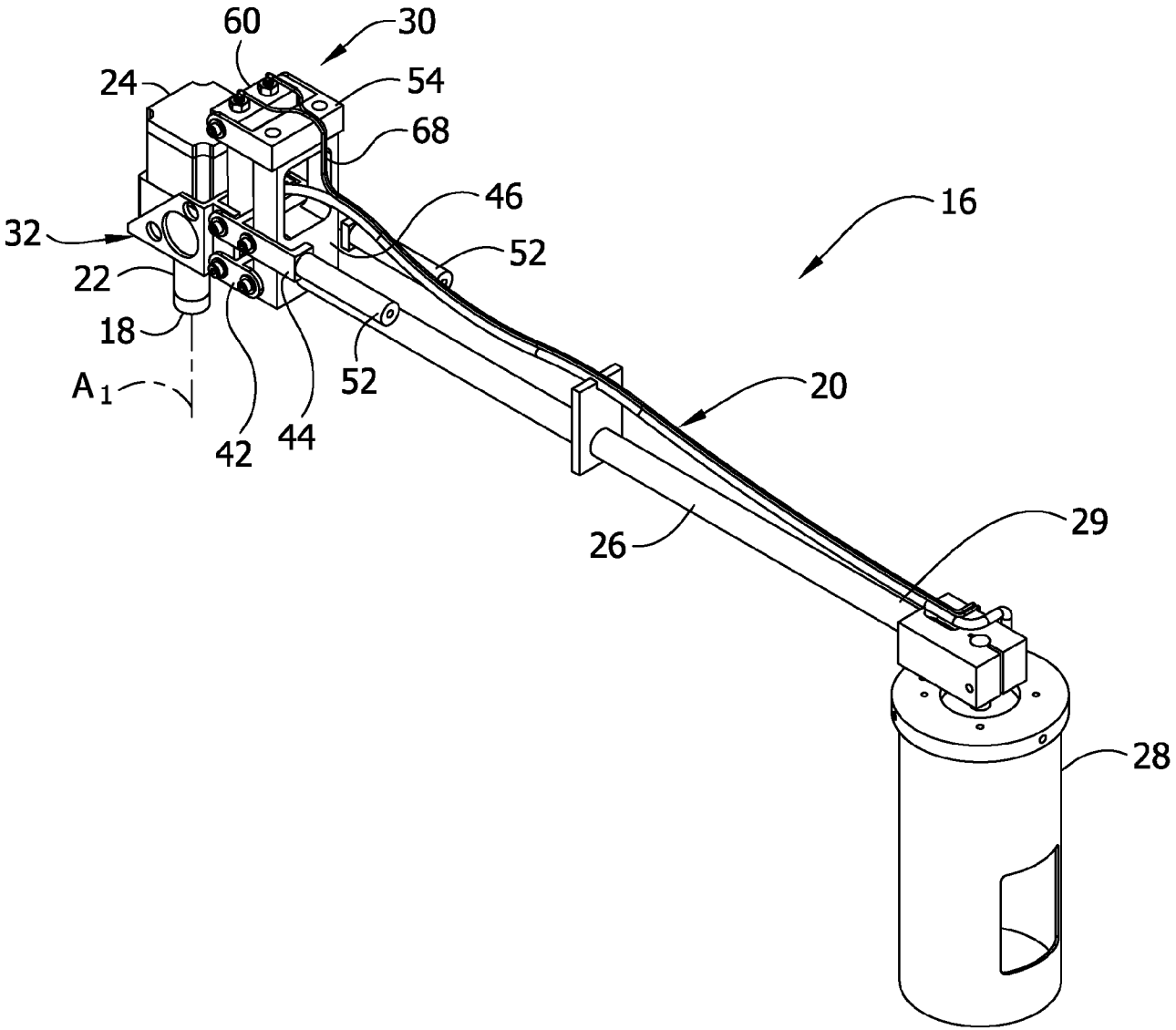
FIG. 2 is a perspective of a dressing apparatus of the polishing system of FIG. 1.
Figure 3:
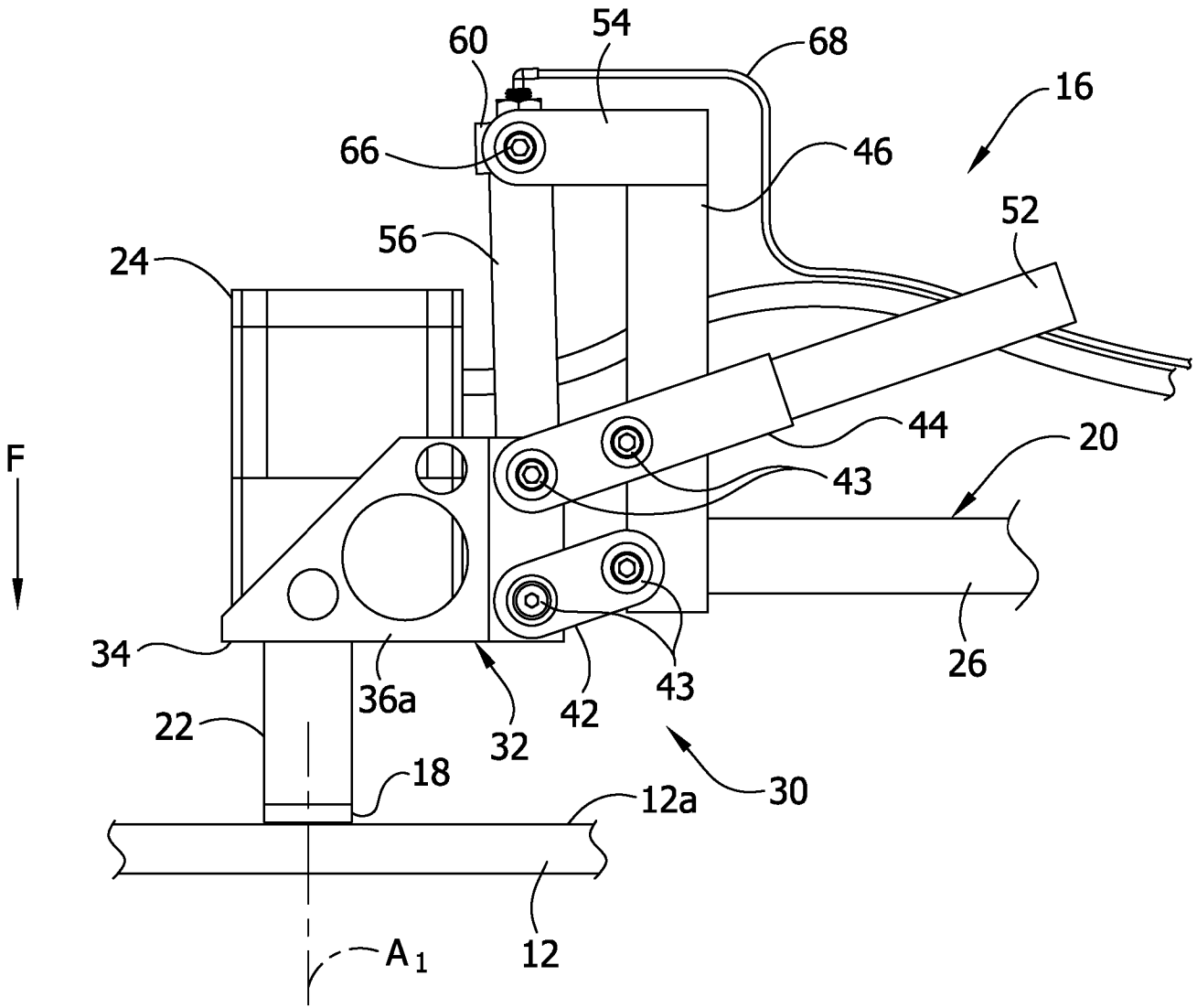
FIG. 3 is a fragmentary side elevation of the dressing apparatus illustrating actuators of the dressing apparatus applying a downward force on a motor mount of the dressing apparatus.

Referring now to FIGS. 2 and 3, the dressing apparatus 16 includes a dressing wheel 18 (broadly, a dressing member) mounted on a pad dressing system, generally designated by 20. The dressing wheel 18 may be diamond impregnated, such as those manufactured by Kinik Company of Taiwan. In one embodiment, a dressing surface of the wheel 18 (i.e., the surface of the wheel that contacts the polishing pad) may have a diameter between about 30 mm and about 10 mm, for example, about 20 mm. As will become apparent and also explained in more detail below, a small dressing surface provides for more precise dressing of the polishing pad 12, so the pad produces flatter, smoother and/or more uniform polished wafers.

As explained in detail below, individual components of the pad dressing system 20 rotate the dressing wheel 18, move the dressing wheel radially along the polishing surface of the polishing pad, and exert a selected amount of force on the polishing surface via the dressing wheel. The pad dressing system 20 may include additional or alternative components and devices. The dressing wheel 18 is secured to an output shaft 22 of a dressing motor 24 (e.g., an electric motor) for rotating the dressing wheel about an imaginary axis A1 of the output shaft. The axis A1 is generally perpendicular to the polishing surface 12*a* of the polishing pad 12 (FIG. 3) when the dressing apparatus 16 is dressing the pad. Thus, in use the dressing wheel 18 rotates about a rotational axis corresponding to the axis A1 of the output shaft 22 that is generally perpendicular to the surface 12*a* of the polishing pad 12.

Figure 10:
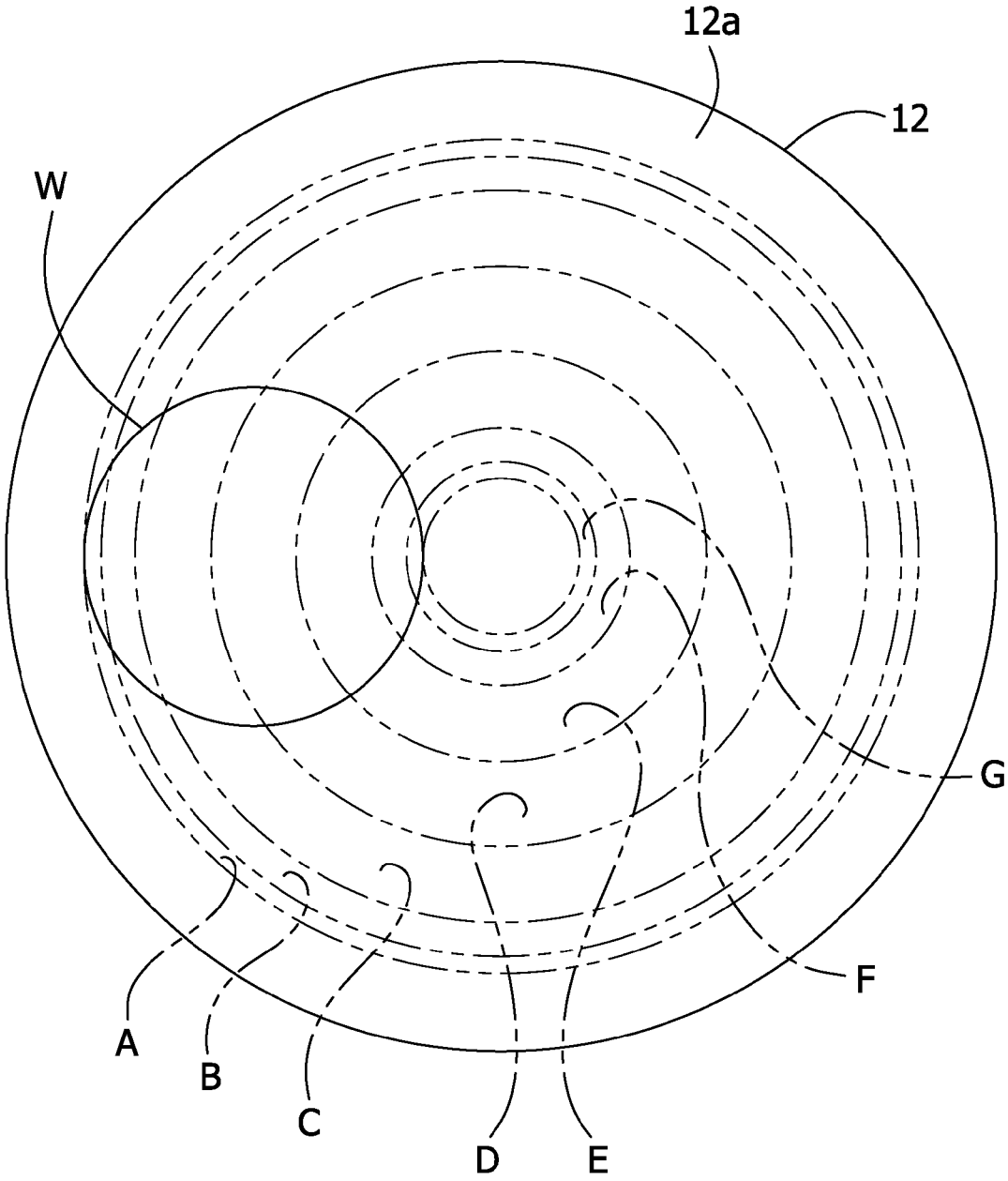
FIG. 10 is a schematic of the polishing pad illustrating radial zones of the polishing surface of the pad.

Referring to FIGS. 2 and 4, the dressing wheel 18 and dressing motor 24 are disposed at a first end of an extension arm 26 of the dressing apparatus 16. The extension arm 26 is pivotally connected to an arm motor 28 at its second end 29. The arm motor 28 of this embodiment is adapted to swing the extension arm 26 and the dressing wheel 18 over the polishing surface 12*a* of the polishing pad 12 along a generally arcuate path (FIG. 4). The length of the extension arm 26, and the position of the arm motor 28 (i.e., the pivot point of the extension arm) allow the dressing wheel 18 to sweep radially across the polishing surface 12*a* from an outer edge of the surface toward its center. As can be seen in FIGS. 4 and 10, only a functional portion of the polishing surface 12*a*, not the entire surface, actually polishes a wafer W. This is because the diameter of the polishing surface (e.g., about 546.1 mm (21.5 in) is more than twice the diameter of the wafer W (e.g., about 200 mm (7.87 in). Thus, only this functional portion of the polishing surface 12*a* need be dressed by the dressing apparatus 16. The polishing pad 12 rotates as the dressing wheel 18 dresses the polishing surface 12*a*, allowing the dressing apparatus 16 to dress the entire functional portion of the surface.

Figure 5:
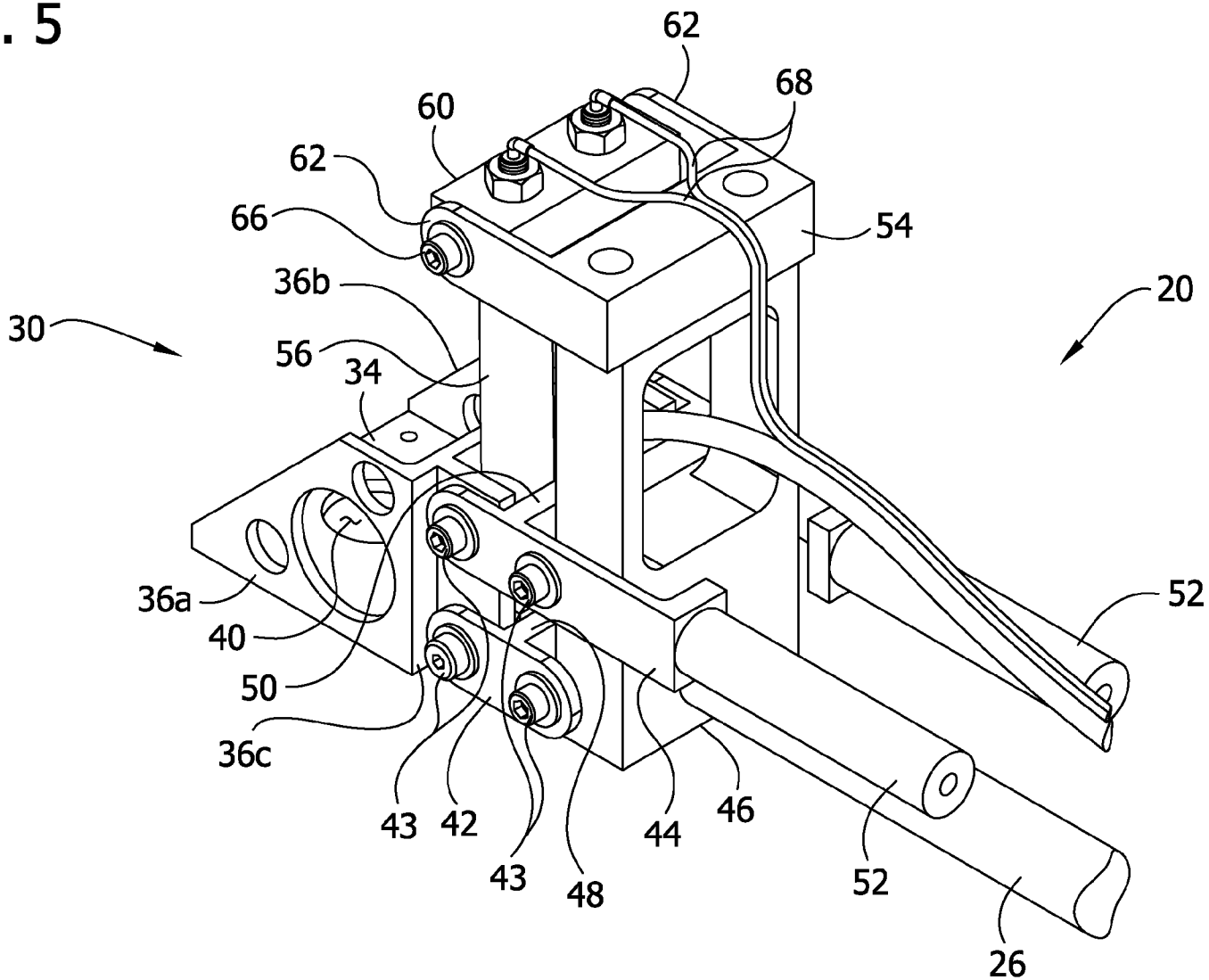
FIG. 5 is a fragmentary perspective of a portion of the dressing apparatus with a dressing motor removed for clarity.
Figure 6:
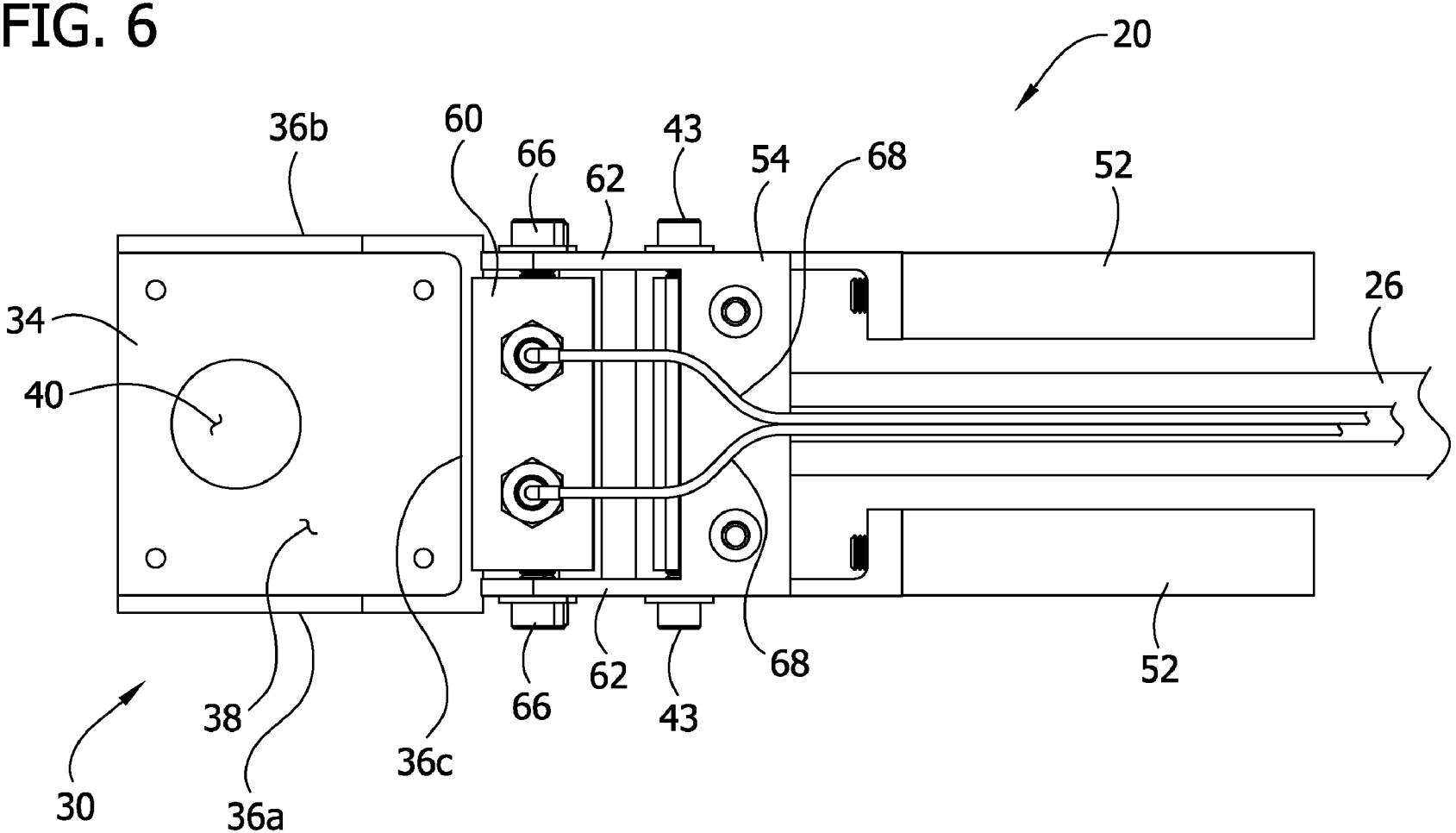
FIG. 6 is a top plan of the dressing apparatus of FIG. 5.

Referring to FIGS. 3, 5 and 6, the pad dressing system 20 includes a load-applying device 30 that is adapted to apply a selective, generally perpendicular force F (FIG. 3) or load on the polishing surface 12*a* of the polishing pad 12 via the dressing wheel 18 as the wheel dresses the polishing pad. For example, in the illustrated embodiment, the dressing wheel 18 applies a generally vertical, downward force on the polishing surface 12*a* and the polishing surface lies in a generally horizontal plane. The load-applying device 30 includes a motor mount 32 secured to the first end of the extension arm 26 for mounting the dressing motor 24 thereon. As shown in FIGS. 5 and 6, the motor mount 32 includes a platform 34 and opposing side walls 36*a*, 36*b* and a rear wall 36*c* extending upward from the platform defining an enclosure 38 for receiving the dressing motor 24. An opening 40 (FIG. 5) extends through the platform 34 for receiving the shaft 22 of the dressing motor 24.

A pair of lower link members 42 (broadly, lower arms) and a pair of upper link members 44 (broadly, upper arms) extend rearward from both sides walls 36*a*, 36*b* of the motor mount 32 to a vertical post 46 that is fixedly secured to the free end of the extension arm 26. As shown in FIG. 5, the lower link members 42 are secured together by a lower crossbar 48, and likewise, the upper link members 44 are secured together by an upper crossbar 50. The lower link members 42 and lower crossbar 48 may be integrally formed as one piece, and the upper link members 44 and upper crossbar 50 may be integrally formed as one piece. The motor mount 32 is pivotally secured to each of the lower and upper link members 42, 44, respectively, and the lower and upper link members are pivotally secured to the vertical post 46. The motor mount 32 is rotatably secured to the lower and upper link members 42, 44 and the link members are rotatably secured to the vertical post 46 using, for example, fasteners 43. As explained in more detail below, the link members 42, 44 allow the motor mount 32, and more specifically, the platform 34 of the motor mount to remain substantially parallel to the polishing surface 12*a* of the pad 12 as the motor mount moves toward and away from the polishing surface (e.g., down and up, respectively). In this way, the dressing wheel 18 also remains substantially parallel to the polishing surface 12*a*.

Figure 7:
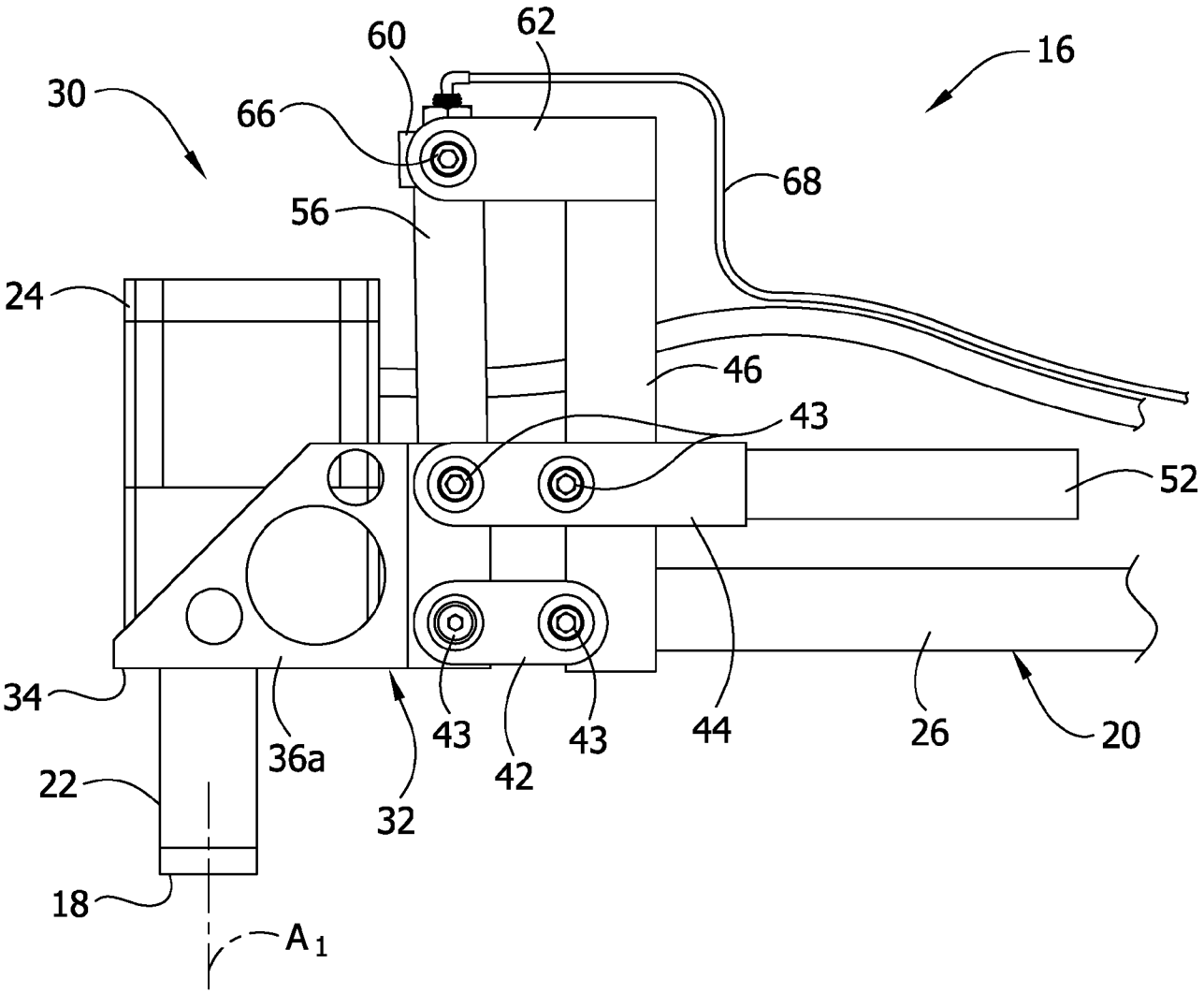
FIG. 7 is a fragmentary side elevation of a portion of the dressing apparatus similar to FIG. 3 but with the actuators applying zero force on the motor mount.

Rear ends of the upper link members 44 adjacent the vertical post 46 have counterweights 52 attached thereto for substantially balancing the weight of the motor mount 32, dressing motor 24 and dressing wheel 18. As shown in FIG. 7, with no other force acting on the motor mount 32 except gravity, the motor mount will be in a substantially horizontal position, in which the link members 44, 42 are generally horizontal and parallel to the extension arm 26 and the polishing surface 12*a* of the pad 12. Accordingly, the load-applying device 30 is constructed so that any force applied to the motor mount 32 equals the resulting net force applied to the polishing surface 12*a* via the dressing wheel 18.

Figure 9:
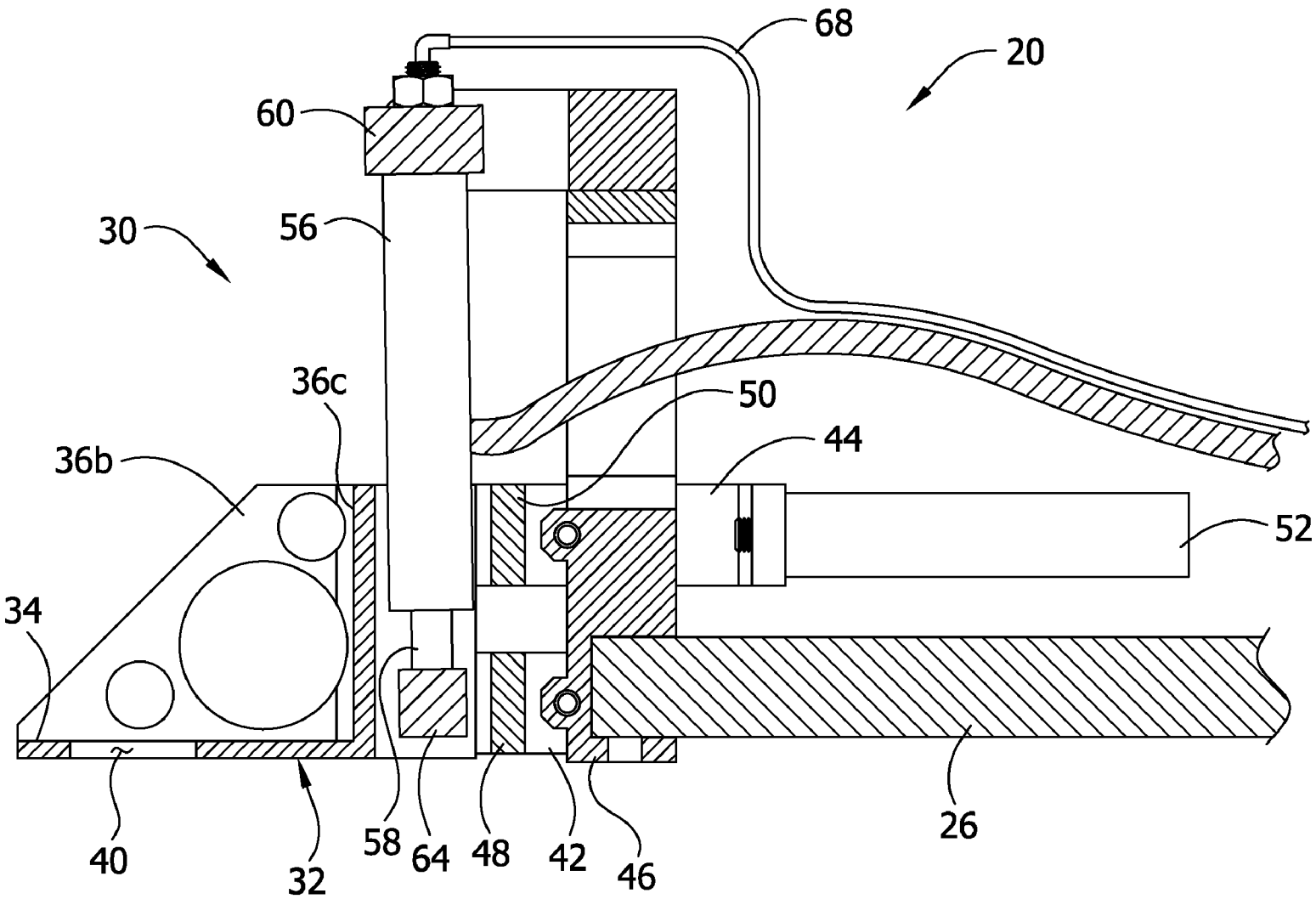
FIG. 9 is a longitudinal section of the dressing apparatus of FIG. 7.

Referring to FIGS. 3, 5, 6 and 9, a generally U-shaped bracket member 54 extends outward from an upper portion of the vertical post 46 away from the extension arm 26 and toward the motor mount 32. Pneumatic actuators 56 are pivotally secured side by side to the U-shaped bracket 54 and extend downward from the bracket for moving the motor mount 32 up and down. Lower ends of the pistons 58 of the actuators 56 are pivotally secured to the motor mount 32. The upper portions of the actuators 56 are fixedly secured within a mount 60 and rotatably secured to arms 62 of the U-shaped bracket 54 allowing the actuators 56 to pivot with respect to the bracket. Referring to FIG. 9, the free ends of the pistons 58 of the actuators 56 are fixedly secured within a cradle 64, which is rotatably secured to the motor mount 32 allowing the pistons to pivot about the motor mount. The mount 60 may be pivotally secured to the arms 62 of the U-shaped bracket 54 by fasteners 66.

The pneumatic actuators 56 are fluidly connected to a source of compressed air (not shown) via inlet tubing 68 and an inlet valve (not shown). Pressure within the actuators 56 may be relieved through bleed valves (not shown). Because the counterweights 52 substantially cancel out any force caused by the weight of the motor mount 32, dressing motor 24 and dressing wheel 18, air pressure within the actuators 56 and the amount of force applied to the motor mount by the actuators correlates directly to the amount of force F applied to the polishing surface 12*a* of the polishing pad 12 by the dressing wheel. The actuators 56 may be other than pneumatic, such as hydraulic or electric, within the scope of the invention.

As mentioned above, the link members 42, 44 allow the platform 34 of the motor mount 32 to remain substantially horizontal and parallel to the polishing surface 12*a* of the polishing pad 12 such that the dressing wheel 18 remains generally horizontal and parallel to the polishing surface of the polishing pad. As illustrated in FIG. 7, when the actuators 56 are not applying a force to the motor mount 32, the motor mount and the link members 42, 44 are generally horizontal and parallel to the polishing surface 12*a* of the pad 12. As shown in FIG. 3, when the pistons 58 are extended and exerting a downward force on the motor mount 32, the upper and lower link members 42, 44 rotate downward relative to the vertical post 46 about the corresponding fasteners 43. At the same time, the motor mount 32 remains level. Moreover, the mount 60 and thus the upper portions of the pneumatic actuators 56 remain plumb. Thus, through this arrangement, the motor mount 32 remains substantially parallel to the polishing surface 12*a* of the polishing pad 12 (e.g., substantially horizontal) so the dressing wheel 18 remains in flush contact with the polishing surface of the polishing pad as the motor mount moves up and down.

Figure 8:
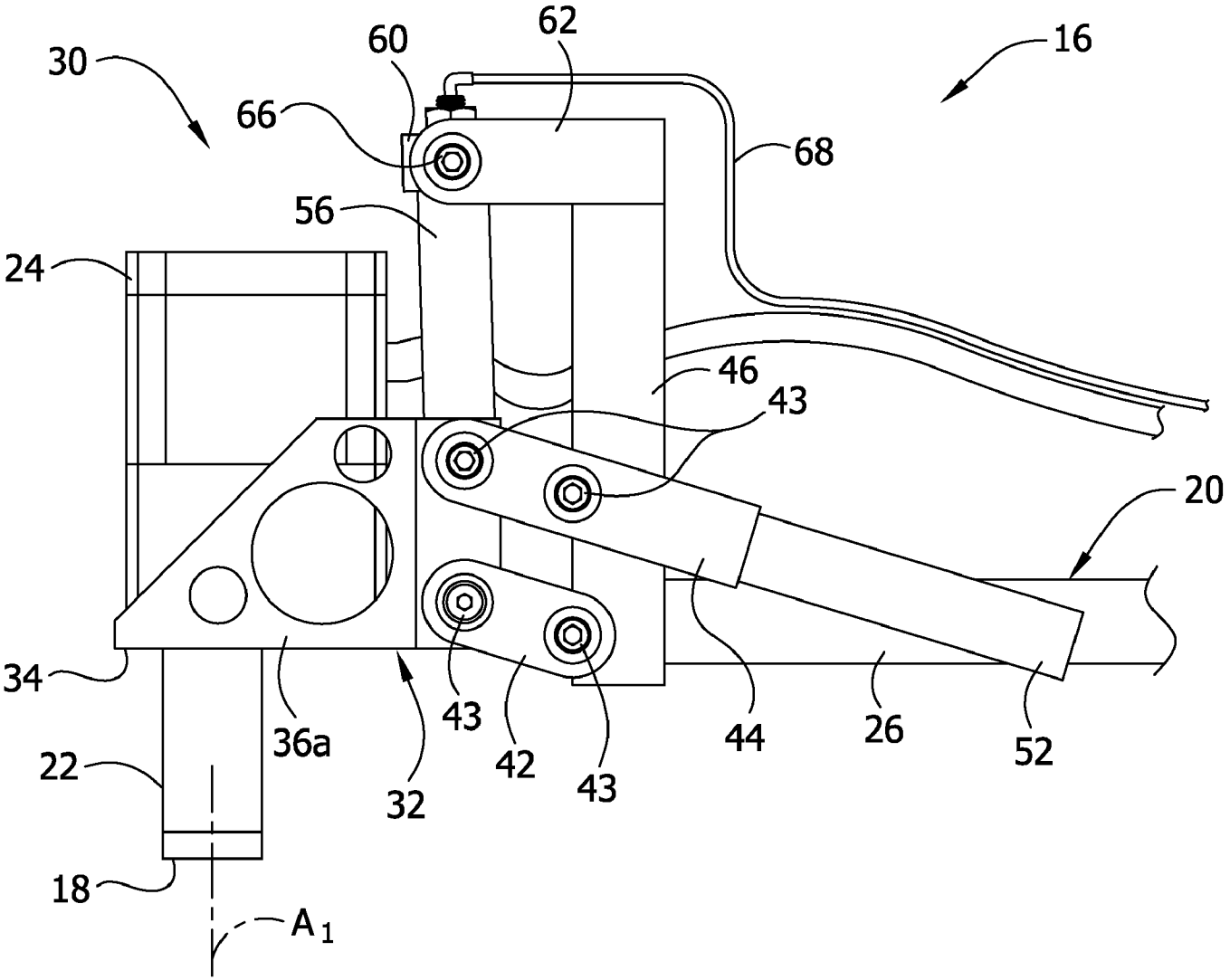
FIG. 8 is a fragmentary side elevation of the dressing apparatus similar to FIG. 3 but with the actuators applying an upward force on the motor mount to raise the mount to an elevated position.

As illustrated in FIG. 8, the dressing apparatus 16 may be constructed such that when the pistons 58 of the actuators 56 are fully retracted and applying an upward force on the motor mount 32, the upper and lower link members 42, 44 rotate upward about the corresponding fasteners 43. In this way, the motor mount 32 may be elevated above its neutral position to prevent contact between the dressing wheel 18 and the polishing pad 12 while the extension arm 26 swings the dressing wheel back to its original position after completion of the dressing process.

Figure 11:
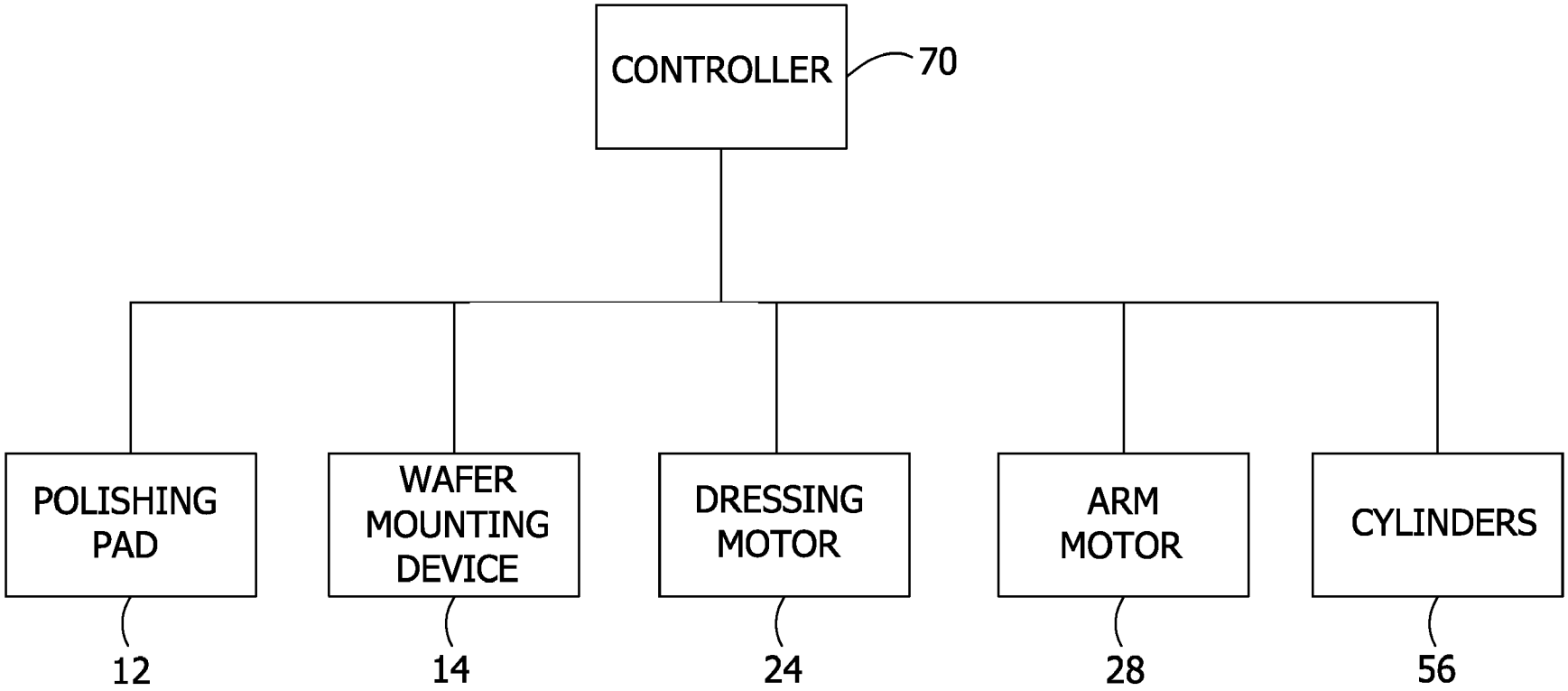
FIG. 11 is a schematic of an integrated system including a controller and the wafer polishing system.

In one embodiment, a controller 70 (FIG. 11), such as a microcontroller, controls the pneumatic actuators 56 to dress the polishing pad 12. As illustrated schematically in FIG. 11, the controller 70 may also control motion of the polishing pad 12 (e.g., the rotatable base of the polishing pad), the wafer mounting device 14 (e.g., the rotatable head of the mounting device), the dressing motor 24 and the arm motor 28. As explained in more detail below, the microcontroller 70 dresses wafers W located at individual radial zones of the functional portion of the polishing surface 12*a* according to a set of preprogrammed instructions or a preprogrammed "dressing recipe". That is, the microcontroller 70 adjusts the amount of force applied to individual radial zones of the polishing pad 12 by the dressing wheel according to the instructions given in a pre-programmed recipe. In one example, a feedback circuit is used, and the controller 70 controls the inlet and bleed valves, which may be solenoid valves, to adjust the pressures in the actuators 56 according to the recipe. Thus, the controller 70 adjusts the pressures in the actuators 56 when the dressing wheel 18 is moving radially along the polishing surface 12*a* to increase or decrease force applied to the polishing surface.

The actuators 56 are also capable of exerting a constant force F on the polishing surface 12*a* of the polishing pad 12 as the dressing wheel 18 dresses the pad radially. Accordingly, when the dressing wheel 18 encounters a low spot or a high spot in a radial portion of the polishing surface 12*a*, the controller 70 may have to provide more or less air to the actuators to maintain constant pressure in the actuators. Otherwise, if the dressing wheel 18 and therefore the motor mount 32 moved upward, for example, when encountering a high spot, the pistons 58 of the actuators 56 would also be forced upward, and if the actuators did not allow for adjustment of air pressure, then the air pressure within the actuators would increase, resulting in an increase in the force exerted by the pistons and in an increase in the force F exerted on the polishing surface 12*a* at the high spot. In one example, a feedback circuit is used, and the controller 70 controls the inlet and bleed valves of the actuators 56 to adjust the pressures in the actuators according to the change in pressures due to high and low spots on the polishing surface 12*a*.

Because it is typically advantageous to change the force F exerted by the dressing wheel 18 along the radius of the polishing surface 12*a* and because the dressing apparatus 16 moves up and down along the contours of each radial portion of the polishing surface, the pneumatic actuators 56 preferably have very low hysteresis. Such actuators 56 having very low hysteresis are typically referred to as "hysteresis-free actuators", although the actual hysteresis may be between about 5% and about −5% of the load applied. The hysteresis-free actuators may be constructed of a graphite actuator that slides smoothly, without lubrication, within a Pyrex glass actuator. Through this construction, the actuator has very low static friction at the beginning of a stroke, resulting in very low hysteresis. The hysteresis-free actuators 56 allow for controller 70 to precisely change the force F exerted on the polishing surface 12*a* by the dressing wheel 18 because the correlation between the pressure within the air actuators and the force exerted on the polishing surface will remain constant regardless of whether the piston is extending or retracting. Without hysteresis-free actuators 56, the amount of pressure within the actuators may not directly correlate to the amount of pressure exerted on the polishing pad 12 by the dressing wheel 18. The same holds true for changing the air pressure in the actuators 56 to maintain a constant force F. Without hysteresis-free actuators 56, the pressure in the actuators may not directly correlate to the amount of force F exerted by the actuators 56.

Referring to FIG. 10, in one embodiment the microcontroller 70 adjusts the amount of force exerted on individual radial zones A, B, C, D, E, F and G of the polishing surface 12*a* according to a selected pre-programmed dressing recipe. In one example, the dressing recipes are based on the shape of the polished surface of at least one sampled polished wafer produced by the polishing system 10. More specifically, the average radial two-dimensional profiles of the wafers are used. It is understood that the shape of the polished surface of the wafer may be generalized or characterized in other ways besides analyzing its average radial two-dimensional profile. For example, a three-dimensional profile may be used.

The dressing recipes may be formulated through empirical data. For example, the average two-dimensional radial profiles of the polished surfaces of numerous polished wafers may be analyzed so that wafers having similarly shaped polished surfaces can be categorized into a shape category. The optimal dressing process for wafers in each category (i.e., the optimal amount of force F to apply in each radial zone of the polishing surface 12*a*) may be determined empirically. Thus, tests may be performed to determine the optimal amount of force F to apply in each radial zone for each developed category.

In use, a wafer measuring device (not shown), such as an ADE UltraGage 9700, measures the thickness of a sampled polished wafer. The thickness of the polished wafer is extrapolated through 360 degrees to obtain an average radial two-dimensional profile of the sampled wafer. The sampling rate for obtaining the average radial profile of a previously polished wafer may be about 1 wafer from every 25 wafers polished. It is understood that a greater number of wafers may be polished between samplings, or alternatively, fewer wafers may be polished between samplings. Moreover, the sampling rate may change during the life of the polishing pad.

The radial profile of the sampled wafer may be categorized by an operator. Based on the category in which the sampled wafer falls, the operator selects an appropriate preprogrammed recipe from those input to a microcontroller 70. For example, a specific preprogrammed dressing recipe may be used for dressing the polishing pad when the polishing pad produces a sampled wafer having a polished surface with a concave average radial two-dimensional profile, and a different preprogrammed dressing recipe may be used for dressing the polishing pad when the polishing pad produces a sampled wafer having a polished surface with a convex average radial two-dimensional profile. The selected recipe instructs the microcontroller 70 to apply a selected amount of force to each radial zone of the polishing pad. Those skilled in the art will appreciate that the number of radial zones may vary, depending on the desired precision of the dressing process. The microcontroller 70 controls the pneumatic actuators, more particularly, the amount of pressure in the actuators, to adjust the force exerted on the polishing pad according to the selected recipe. It is contemplated that the entire procedure may be automated, so the microcontroller 70 measures a polished wafer, analyzes the radial profile of the sampled polished wafer and chooses the appropriate dressing recipe based on the radial profile of the sampled polished wafer.

Using this procedure, the polished wafer, not the polishing surface 12*a* of the polishing pad 12, is analyzed to determine an appropriate dressing process for the polishing pad. In general, it is believed that deriving a dressing process based on the sampled polished wafer is easier and more efficient than deriving a dressing process based on the polishing surface 12*a* of the polishing pad 12. However, the radial profile of a polished wafer can be readily and accurately measured, and the radial profile may be analyzed to also readily determine not only which areas of the polishing pad need to be dressed, and to what extent the specific areas need to be dressed.

As can be seen from the below exemplary dressing recipes, in general a larger force F is applied to the zones of the polishing surface 12*a* corresponding to portions of the wafer that are thinner than average. Likewise, a smaller force F is applied to the zones of the polishing surface 12*a* that polish portions of the wafer that are thicker than average. In general, a zone of the polishing surface 12*a* having a greater thickness than other zones of the polishing pad will thin out the corresponding wafer location more than other zones of the polishing pad. Thus, the polishing surface zones having a higher profile need more force applied to them to thin them out, and polishing pad zones having a lower profile need less force applied to them. Dressing the different zones of the polishing surface 12*a* based on the radial profiles of polished wafers is an accurate way of producing polished wafers with substantially uniform thicknesses.

Exemplary Procedures

Following are examples of dressing processes using the above-described embodiment of the dressing system with a 20 mm diameter dressing wheel to dress three categories of polishing pads. For purposes of the following examples, the functional portion of the polishing pad (i.e., the portion of the pad that dresses the wafer) is divided into seven radial zones A, B, C, D, E, F and G as depicted in FIG. 10. For purposes of these examples, the functional portion is given as a one-dimensional coordinate system spanning from the outer periphery of the portion to the inner periphery portion. Thus, the outer periphery of the functional portion has a coordinate of 0 mm and the inner periphery has a coordinate of 200 mm. Radial zone A extends from 0 mm to 10 mm. Radial zone B extends from 10 mm to 30 mm. Radial zone C extends from 30 mm to 75 mm. Radial zone D extends from 75 mm to 125 mm. Radial zone E extends from 125 mm to 170 mm. Radial zone F extends from 170 mm to 190 mm. Radial zone G extends from 190 mm to 200 mm.

Empirical studies were used to determine an optimal force applied to each zone of the polishing pad. Loads may differ from those shown without departing from the scope of this invention. It is also understood that there may be numerous other processes for the dressing apparatus, in addition to or in place of these exemplary processes.

EXAMPLE 1

Dished-Shaped Wafer

Figure 12:
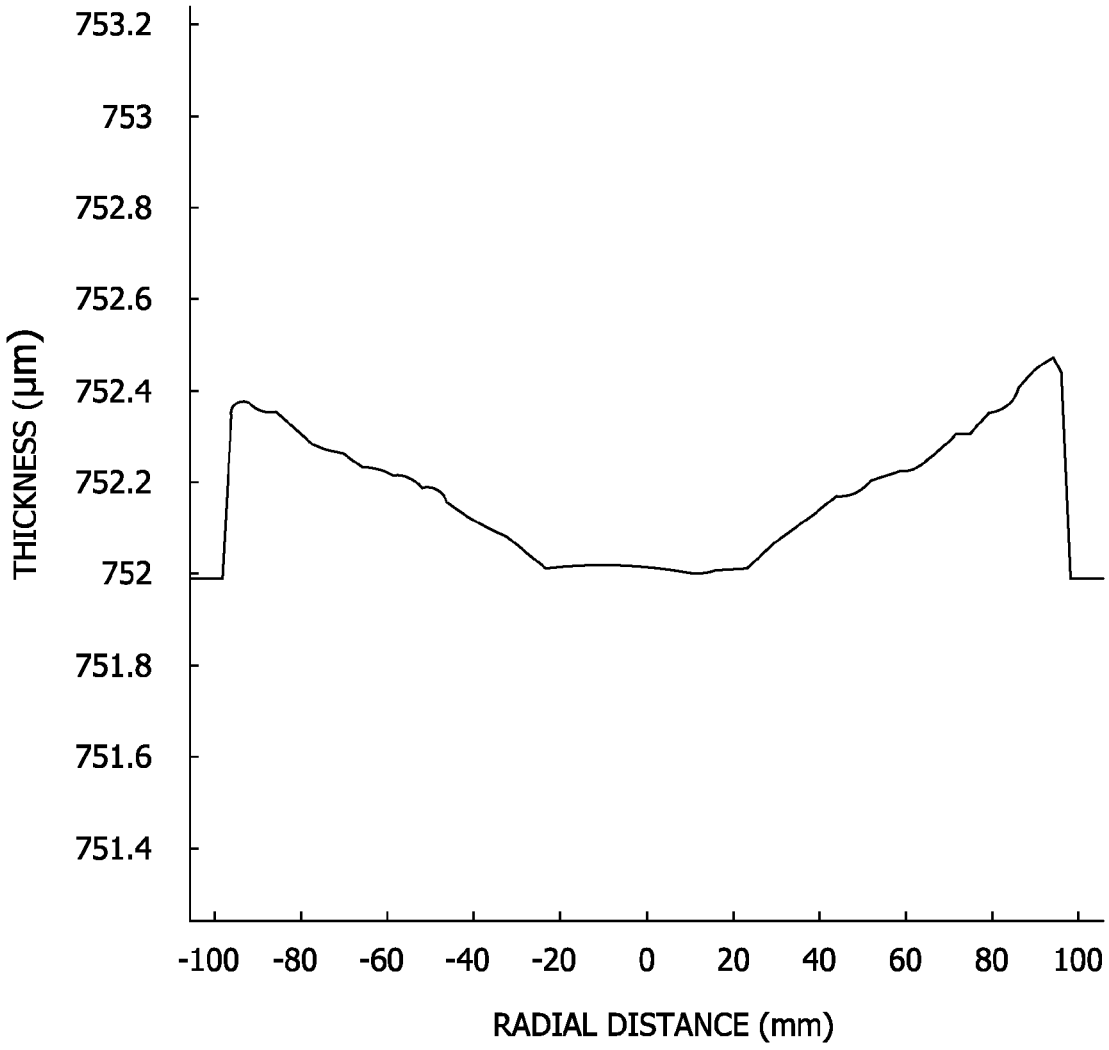
FIG. 12 is a graphical representation of a two-dimensional radial profile of a wafer having a dish-shaped polished surface.

One procedure for dressing a polishing pad that produced a dished-shaped wafer is provided by this example. A radial profile of a dished wafer is illustrated in FIG. 12. In general, a dished wafer has a greater thickness adjacent its periphery and gradually decreases in thickness radially towards its center. Thus, the polished surface of the wafer is generally concave.

The following table provides exemplary loading for a polishing pad producing dished wafers:

| Radial Zone | Load Applied (N) |
|---|---|
| A | 0.067 |
| B | 0.067 |
| C | 0.500 |
| D | 1.000 |
| E | 0.500 |
| F | 0.067 |
| G | 0.067 |

EXAMPLE 2

Dome-Shaped Wafer

Figure 13:
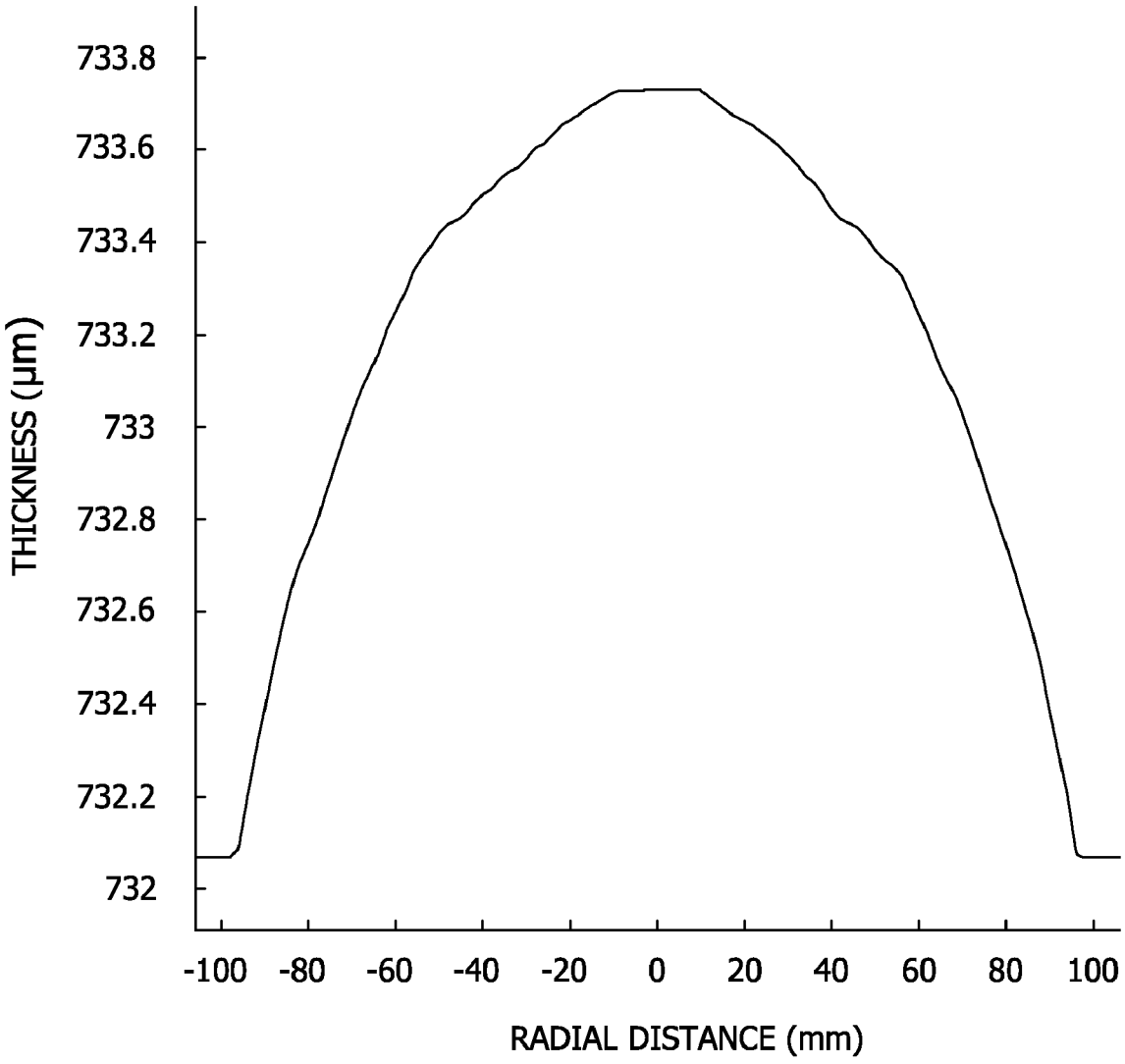
FIG. 13 is a graphical representation of a two-dimensional radial profile of a wafer having a dome-shaped polished surface.

One procedure for dressing a polishing pad that produced a dome-shaped wafer is provided by this example. A radial profile of a domed-shaped wafer is illustrated in FIG. 13. In general, a dome-shaped wafer is thinner adjacent its periphery and gradually increases in thickness at its center. Thus, the polished surface of the wafer is generally convex.

The following table provides exemplary loading for a polishing pad producing domed wafers:

| Radial Zone | Load Applied (N) |
|---|---|
| A | 1.000 |
| B | 0.834 |
| C | 0.500 |
| D | 0.067 |
| E | 0.500 |
| F | 0.834 |
| G | 1.000 |

EXAMPLE 3

Double-Hump Wafer

Figure 14:
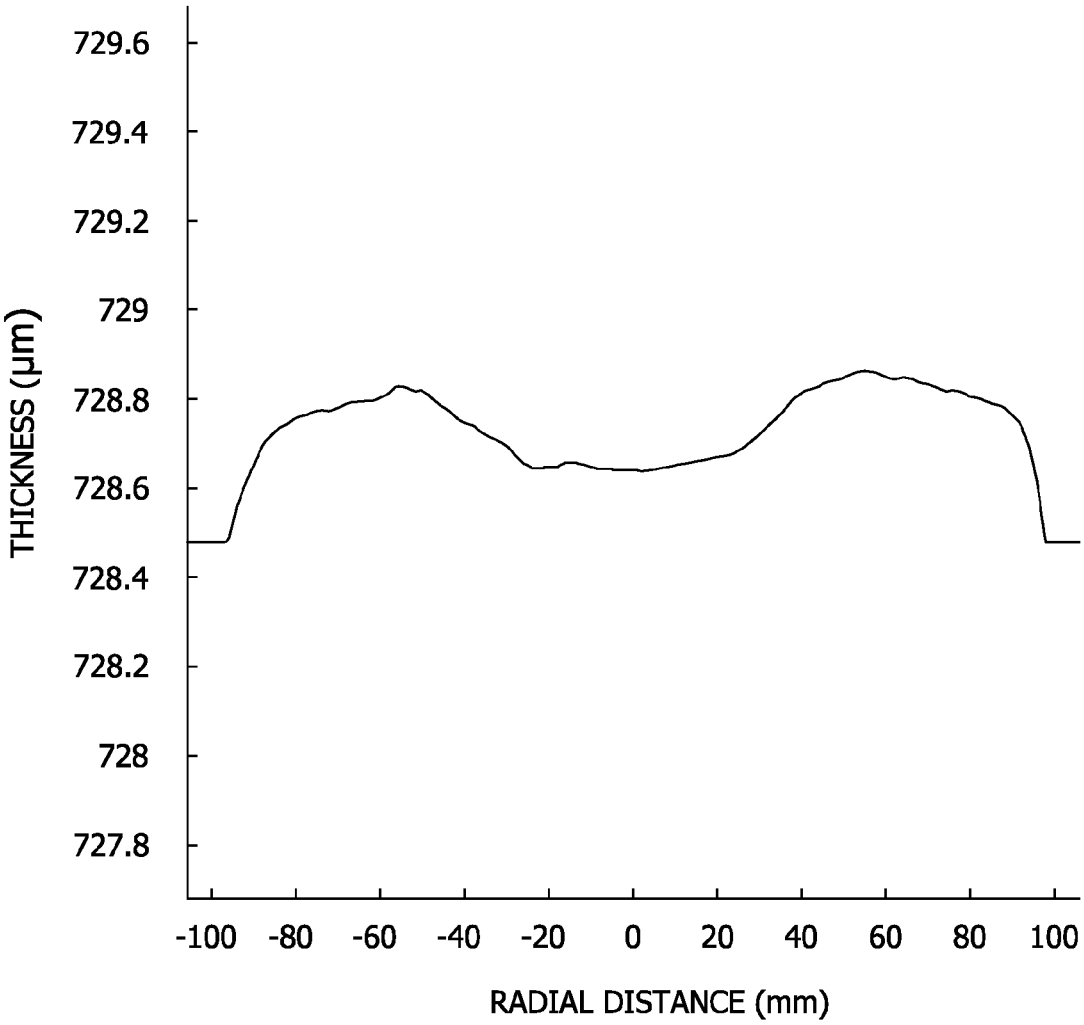
FIG. 14 is a graphical representation of a two-dimensional radial profile of a wafer having a double-hump-shaped polished surface.

One procedure for dressing a polishing pad that produced a double-hump wafer is provided by this example. A radial profile of a double-annular-hump wafer is illustrated in FIG. 14. In general, a double-hump wafer is thinner adjacent its periphery, gradually increases in thickness radially towards its center, and then gradually decreases in thickness adjacent its center. Thus, the polished surface of the wafer has two humps between its center and its periphery.

The following table provides exemplary loading for a polishing pad producing double-hump wafers:

| Radial Zone | Load Applied (N) |
|---|---|
| A | 0.800 |
| B | 0.080 |
| C | 0.400 |
| D | 1.000 |
| E | 0.400 |
| F | 0.080 |
| G | 0.800 |

Figure 15:
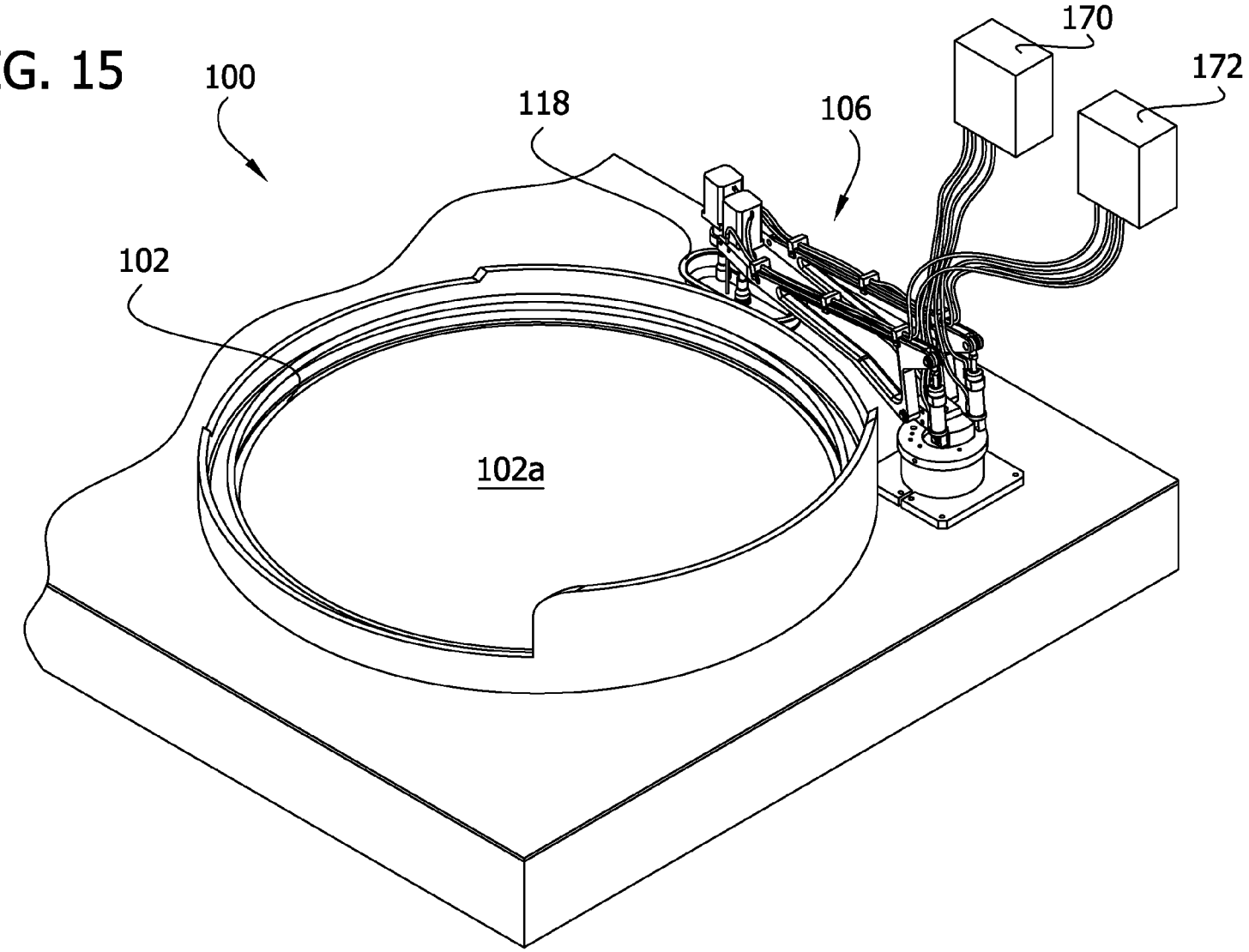
FIG. 15 is a perspective of a second embodiment of a wafer polishing system.

Referring to FIG. 15, a second embodiment of a wafer polishing system constructed according to the principles of the present invention is generally designated in its entirety by the reference number 100. The wafer polishing system 100 includes a polishing pad 102 mounted on a rotatable base (not shown) and a wafer mounting device (not shown) similar to those of the first embodiment. As with the polishing pad 12 of the first embodiment, a surface 102*a* of the polishing pad 102 of the second embodiment polishes a surface of a wafer W (not shown) using abrasives and chemicals. The wafer polishing system 100 includes a dressing apparatus, generally designated by 106, for dressing (i.e., smoothing and flattening) the polishing surface 102*a* of the polishing pad 102 to permit the polishing pad to shape wafers so they have a generally uniform thickness and a smooth surface.

Figure 16:
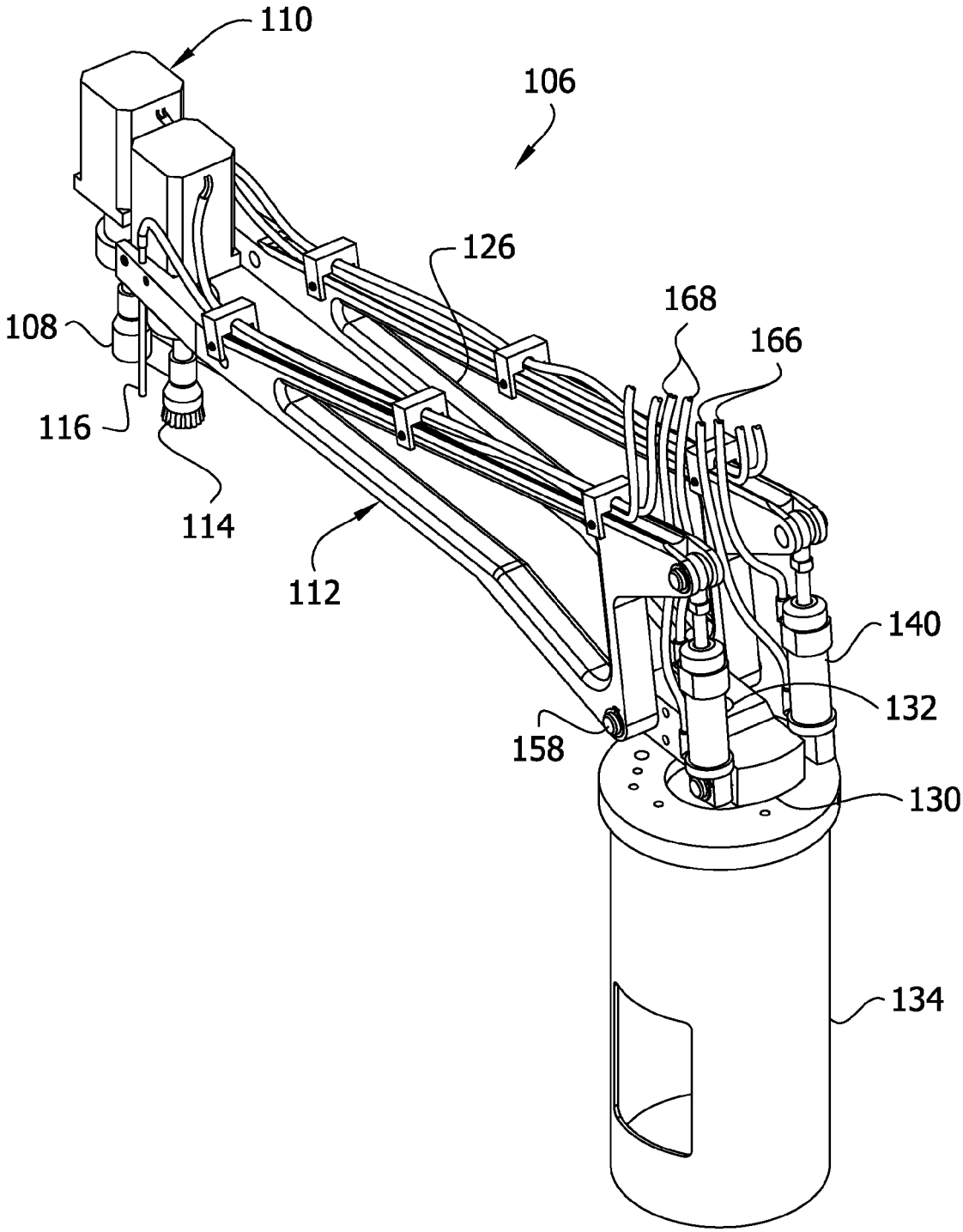
FIG. 16 is a perspective of a dressing apparatus of the polishing system of FIG. 15.
Figure 17:
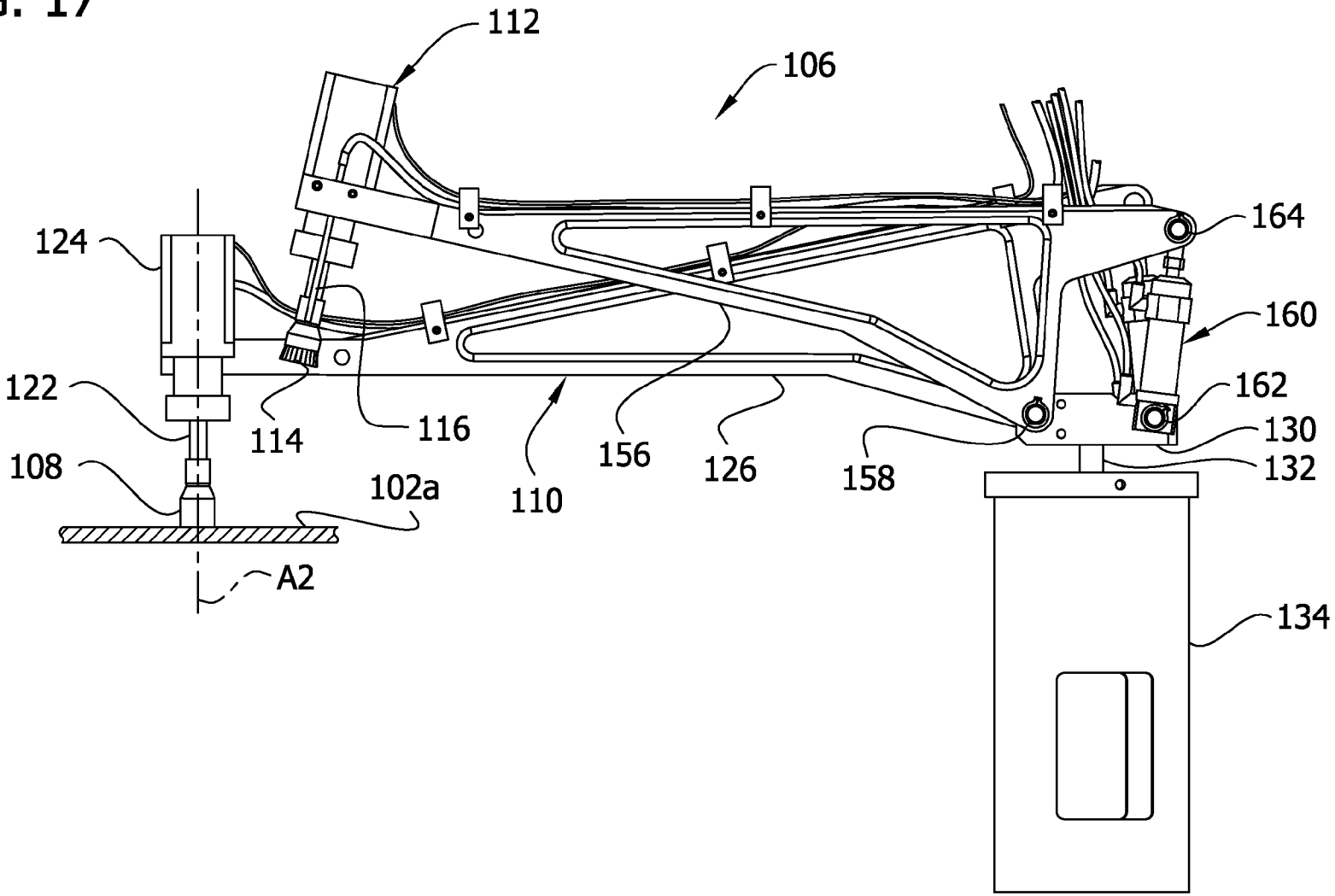
FIG. 17 is a side elevation of the dressing apparatus of the polishing system of FIG. 15 illustrating arms positioned for dressing a polishing surface.
Figure 18:
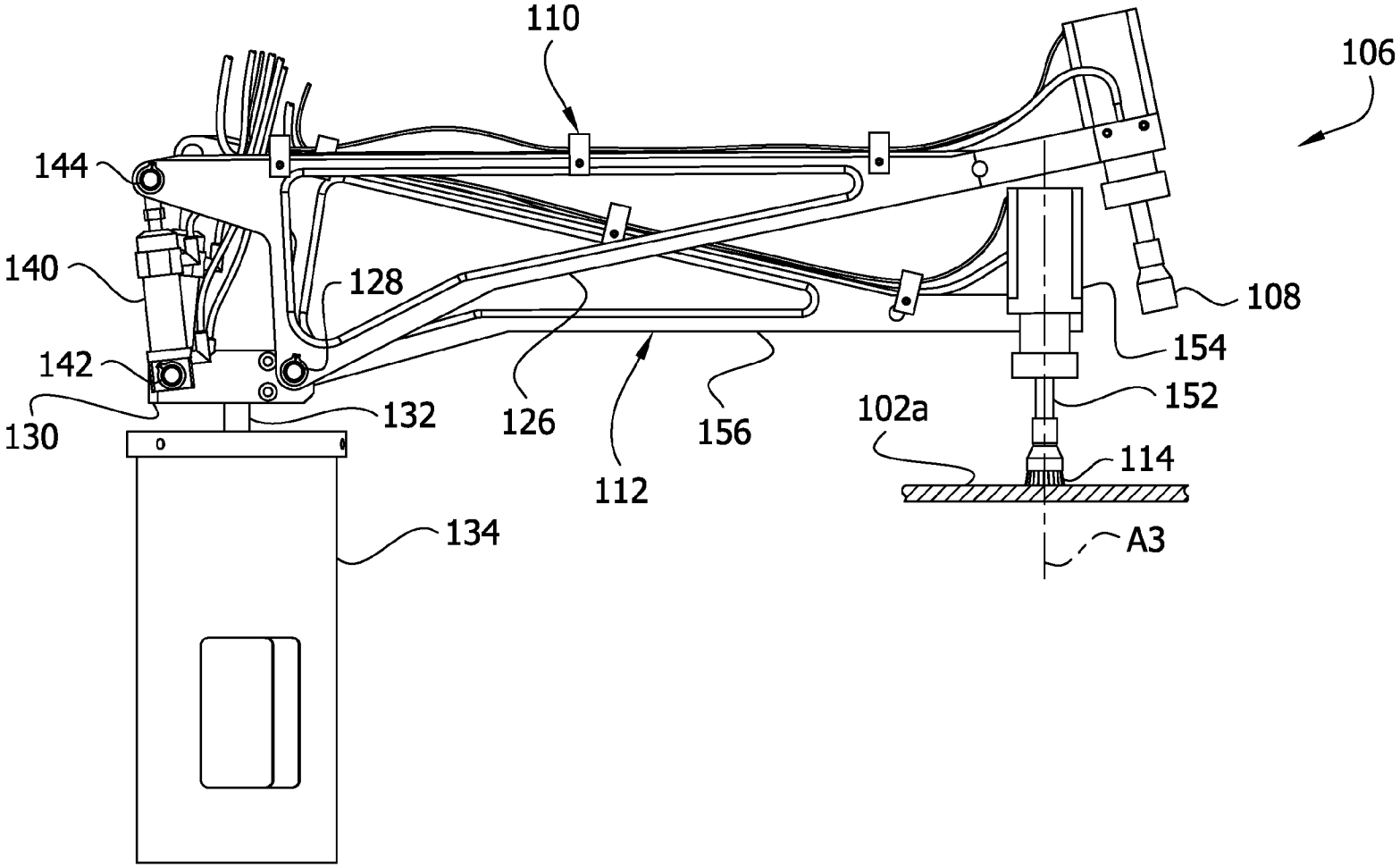
FIG. 18 is a side elevation similar to FIG. 17 illustrating arms positioned for cleaning the polishing surface.

As illustrated in FIGS. 16-18, the dressing apparatus 106 includes a dressing wheel 108 mounted on a pad dressing system, generally designated by 110. In one embodiment, the dressing wheel 108 is diamond impregnated like the type identified above with respect to the dressing wheel of the first embodiment. Further, the dressing surface of the wheel 108 (i.e., the surface of the wheel that contacts the polishing pad 102) of some embodiments has a diameter between about 10 mm and about 30 mm. In one particular embodiment, the dressing surface of the wheel 108 has a diameter of about 20 mm. The dressing apparatus 106 also includes a cleaning system, generally designated by 112. The cleaning apparatus 112 includes a brush 114 and a fluid dispenser 116 for removing chemicals, abrasives and debris from the surface 102*a* of the polishing pad 102 after dressing and/or polishing steps. A well or reservoir 118 is provided below the dispenser 116 when at rest to soak the wheel 108 and brush 114 between uses to remove residual debris and chemicals. The well 118 is filled with fluid from the dispenser 116. In some embodiments, the well continuously overflows into a sump (not shown) so fluid in the well remains fresh and at a constant level. The wheel 108 and brush 114 rotate in some embodiments to enhance cleaning. Although the brush 114 may be made of other materials without departing from the scope of the present invention, in one embodiment the brush is a polyester bristle brush available from McMaster-Carr Supply Company of Atlanta, Ga.

As explained in detail below, individual components of the pad dressing system 110 rotate the dressing wheel 108, move the dressing wheel radially along the polishing surface 102*a* of the polishing pad 102, and push the wheel against the polishing surface. Individual components of the dressing apparatus 106 rotate the brush 114 and move the brush along the polishing surface 102*a* of the pad 102. The pad dressing system 110 may include additional or alternative components and devices without departing from the scope of the present invention.

Referring to FIGS. 16-18, the dressing wheel 108 is secured to an output shaft 122 of a dressing motor 124 (e.g., an electric motor) for rotating the dressing wheel about an imaginary axis A2 of the output shaft. The axis A2 is generally perpendicular to the polishing surface 102*a* of the polishing pad 102 when the dressing apparatus 106 is dressing the pad. Thus, in use the dressing wheel 108 rotates about a rotational axis corresponding to the axis A2 of the output shaft 122 and is generally perpendicular to the surface 102*a* of the polishing pad 102. The dressing wheel 108 and dressing motor 124 are disposed at an end of an arm 126 of the dressing apparatus 106. A pin 128 pivotally connects the arm 126 to a mount 130. The mount 130 is attached to a spindle 132 of a motor 134 (e.g., an electric stepper motor). The motor 134 of this embodiment is adapted to swing the arm 126 and the dressing wheel 108 over the polishing surface 102*a* of the polishing pad 102 along a generally arcuate path. The length of the arm 126 and the position of the motor 134 allow the dressing wheel 108 to sweep across the polishing surface 102*a* from an outer edge of the surface toward its center. As explained above with respect to the first embodiment, only a functional portion of the polishing surface 102*a* actually polishes a wafer W because the polishing surface has a diameter that is more than twice that of the wafer W. Thus, only this functional portion of the polishing surface 102*a* needs to be dressed by the dressing apparatus 106. The polishing pad 102 rotates as the dressing wheel 108 dresses the polishing surface 102*a*, allowing the dressing apparatus 106 to dress the entire functional portion of the surface.

Referring to FIG. 18, the wafer dressing system 110 includes a load-applying device, generally designated by 140, adapted to pivot the arm 126 about the pin 128 so the dressing wheel 108 applies a selected, generally perpendicular force or load on the polishing surface 102*a* of the polishing pad 102 so the wheel dresses the polishing pad. In one embodiment, the load-applying device 140 comprises a pneumatic cylinder. In the illustrated embodiment, the dressing wheel 108 applies a generally vertical, downward force on the polishing surface 102*a* and the polishing surface lies in a plane that is generally horizontal. The load-applying device 140 is pivotally connected to the mount 130 by a lower pin 142 and to the arm 126 by an upper pin 144.

As illustrated in FIGS. 16-18, the cleaning apparatus brush 114 is secured to an output shaft 152 of a motor 154 (e.g., an electric motor) for rotating the brush about an imaginary axis A3. The axis A3 is generally perpendicular to the polishing surface 102*a* of the polishing pad 102 when the cleaning apparatus 112 is cleaning the pad. Thus, in use the brush 114 rotates about a rotational axis corresponding to the axis A3 of the output shaft 152 that is generally perpendicular to the surface 102*a* of the polishing pad 102. The brush 114 and motor 154 are disposed at an end of an arm 156 of the cleaning apparatus 112. The fluid dispenser 116 is also positioned at the end of the arm 156 adjacent the brush 114. The dispenser 116 is operatively connected to a fluid source (not shown) for dispensing fluid to the surface 102*a* and the well 118. In one embodiment, the fluid source provides de-ionized water to the dispenser 116 and the well 118. The arm 156 is pivotally connected to the mount 130 by a pin 158 on a side of the mount opposite the wafer dressing system arm 126. The motor 134 of this embodiment is adapted to swing the arm 156 and the brush 114 over the polishing surface 102*a* of the polishing pad 102 along a generally arcuate path. The length of the arm 156 and the position of the motor 134 allow the brush 114 to sweep across the polishing surface 102*a* from an outer edge of the surface toward its center. The polishing pad 102 rotates as the brush 114 brushes the polishing surface 102*a*, allowing the brush to clean the entire functional portion of the surface.

Referring to FIG. 16, the cleaning system 112 includes a load-applying device, generally designated by 160, adapted to pivot the arm 156 about the pin 158 so the brush 114 applies a selected, generally perpendicular force or load on the polishing surface 102*a* of the polishing pad 102 so the brush sweeps debris and residue from the polishing pad. In one embodiment, the load-applying device 160 comprises a pneumatic cylinder. In the illustrated embodiment, the brush 114 applies a generally vertical, downward force on the polishing surface 102*a* and the polishing surface lies in a plane that is generally horizontal. As shown in FIG. 17, the load-applying device 160 is pivotally connected to the mount 130 by a lower pin 162 and to the arm 156 by an upper pin 164.

The pneumatic actuators 140, 160 are fluidly connected to a source of compressed air (not shown) via tubing 166, 168. Pressure within the actuators 140, 160 may be adjusted by a controller 170 to raise and lower the arms 126, 156, respectively. A second controller 172 may be provided to control flow of fluid to the dispenser 116. Other controllers (not shown) can be used to control operation of the motors 124, 154, 134. As will be appreciated by those skilled in the art, the dressing wheel 108 and brush 114 may be independently raised and lowered and the motor 134 may operated at different speeds depending upon the position of the wheel and brush to optimize dressing and cleaning of the surface 102*a*.

The dressing recipes may be formulated through empirical data using methods similar to those used in the first embodiment. The sequencing of the dressing and cleaning operations will be well understood by those skilled in the art given the capabilities inherent to this system. The dressing recipes are similar to those described above with respect to the first embodiment except that they include cleaning operations in which the brush scrubs the polishing surface and fluid is dispensed on the polishing surface to rinse away debris.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A system for polishing a semiconductor wafer comprising:

a polishing apparatus including a rotatable polishing pad for polishing the wafer;

a dressing apparatus mounted adjacent the polishing pad for dressing the polishing pad, said dressing apparatus including a dressing member engageable with the polishing pad, the dressing apparatus including a rotatable arm;

a cleaning apparatus mounted adjacent the polishing pad for removing particulate and chemicals from the polishing pad, the cleaning apparatus including a rotatable arm, wherein the dressing apparatus arm and the cleaning apparatus arm are mounted for rotation about the same axis; and a controller for controlling the dressing apparatus and the cleaning apparatus.

2. A system as set forth in claim 1 wherein the dressing member is mounted for rotation about an axis generally perpendicular to the polishing pad.

3. A system as set forth in claim 1 wherein the dressing apparatus includes an actuator for forcing the dressing member against the polishing pad.

4. A system as set forth in claim 3 wherein:

the dressing member is mounted on one end of the dressing apparatus arm; and the actuator is mounted on another end of the dressing apparatus arm.

5. A system as set forth in claim 1 wherein the cleaning apparatus includes a brush.

6. A system as set forth in claim 5 the cleaning apparatus includes an actuator for forcing the brush against the polishing pad.

7. A system as set forth in claim 6 wherein:

the brush is mounted on one end of the cleaning apparatus arm; and the actuator is mounted on another end of the cleaning apparatus arm.

8. A system as set forth in claim 5 wherein the cleaning apparatus comprises a fluid dispenser.

9. A system as set forth in claim 1 further comprising a well for holding fluid to soak the dressing apparatus and cleaning apparatus.

10. A dressing system for dressing a polishing surface of a polishing pad for a semiconductor wafer comprising:

a dressing arm having a rotatable dressing member mounted thereon, said dressing arm being mounted for selectively moving the dressing member across the polishing surface and for forcing the member against the polishing pad with a predetermined amount of force; and a cleaning arm having a cleaning member mounted thereon, said cleaning arm being mounted for selectively moving the cleaning member across the polishing surface of the polishing pad, wherein both the dressing arm and the cleaning arm are mounted for rotation about the same axis.

11. A system as set forth in claim 10 wherein said dressing member comprises a wheel.

12. A system as set forth in claim 11 wherein said cleaning member comprises a brush.

13. A system as set forth in claim 12 wherein said dressing arm and said cleaning arm are pivotally mounted for rotation about an axis perpendicular to the polishing surface.

14. A system as set forth in claim 12 wherein said dressing arm and said cleaning arm are pivotally mounted for rotation about an axis parallel to the polishing surface.

15. A system as set forth in claim 14 wherein said dressing arm and said cleaning arm are mounted to rotate about an axis parallel to the polishing surface.

16. A system as set forth in claim 15 wherein the dressing arm and said cleaning arm are mounted to independently rotate about the axis parallel to the polishing surface.

17. A system as set forth in claim 10 wherein said cleaning member comprises a brush.

18. A system as set forth in claim 17 wherein said cleaning member further comprises a fluid dispenser.

19. A system as set forth in claim 10 further comprising a fluid dispenser mounted on the cleaning arm.

20. A method of dressing a polishing surface of a polishing pad used in polishing of wafers comprising:

obtaining a radial profile of a wafer polished with the polishing pad, categorizing the polished wafer into a profile category based on the radial profile of the wafer, selecting a recipe corresponding to the selected category, dressing the polishing surface of the pad according to the selected recipe using a dressing apparatus including a rotatable arm; and cleaning the dressed polishing surface of the pad using a cleaning apparatus including a rotatable arm, wherein the cleaning apparatus arm and dressing apparatus arm are mounted for rotation about the same axis.

21. A method as set forth in claim 20 wherein the cleaning step comprises brushing the dressed polishing surface of the pad.

22. A method as set forth in claim 20 wherein the cleaning step comprises dispensing fluid on the dressed polishing surface of the pad.

* * * * *